US007715747B2

(12) United States Patent
Kitozaki

(10) Patent No.: US 7,715,747 B2
(45) Date of Patent: May 11, 2010

(54) IMAGE HEATING DEVICE WITH COOLING AIR CIRCULATION

(75) Inventor: Yukihiro Kitozaki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 12/166,759

(22) Filed: Jul. 2, 2008

(65) Prior Publication Data

US 2009/0016764 A1 Jan. 15, 2009

(30) Foreign Application Priority Data

Jul. 13, 2007 (JP) ..... 2007-184363

(51) Int. Cl.
*G03G 15/20* (2006.01)

(52) U.S. Cl. ..... 399/92; 399/69

(58) Field of Classification Search ..... 399/92, 399/69

See application file for complete search history.

(56) References Cited

U.S. PATENT DOCUMENTS 6,085,055 A * 7/2000 Shin et al. ..... 399/250
2007/0280721 A1 12/2007 Kanai

FOREIGN PATENT DOCUMENTS

| | | | |
|---|---|---|---|
| JP | 4-51179 | | 2/1992 |
| JP | 2003-76209 | | 3/2003 |
| JP | 2006267426 A | * | 10/2006 |
| JP | 2007-322470 | | 12/2007 |

OTHER PUBLICATIONS

JP 2006-267426, Ono, English Abstract (Pub Date: Oct. 5, 2006).*

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

An image forming apparatus comprising a heating rotating body which heats a toner image while nipping and conveying a recording material bearing the toner image, a fan which cools down the heating rotating body, and a duct adapted in such a manner that air which is blown by the fan so as to cool down the heating rotating body does not pass through a recording material conveying path.

2 Claims, 9 Drawing Sheets

IMAGE HEATING DEVICE WITH COOLING AIR CIRCULATION

BACKGROUND OF THE INVENTION

1. Field of the Invention

The present invention relates to an image heating device for an electrophotographic image forming apparatus such as a copying machine, printer, or facsimile.

2. Description of the Related Art

A method of fixing an unfixed toner image onto a sheet (recording material) in an image forming apparatus, which is conventionally adopted, is a thermal fixing method wherein the toner image which is not yet fixed on the sheet is heated and melted to be thereby fixed onto the sheet because of its favorable stability and fixability.

When the sheet is fixed in a fixing region according to the fixing method, a temperature distribution on a surface of a heating material which transits a sheet-transit region is substantially even.

In the case where small-size sheets each having a width smaller than that of a largest-size sheet are continuously fixed in the fixing region, however, a temperature on the surface of the heating material in a non-sheet-transit region is excessively increased. The temperature increase occurs because, when the small-size sheets are continuously fed, heat is accumulated in a part of the non-sheet-transit region since the heat is not removed by the sheet in the non-sheet-transit region where the sheets do not transit. The phenomenon is called the temperature increase in the non-sheet-transit region (end-portion temperature increase) in an image heating device. When the temperature in the non-sheet-transit region reaches a high temperature, the temperature of the heating material exceeds a temperature-increase limit, which possibly causes damages.

Japanese Patent Applications Laid-Open (JP-A) No. 04-51179 recites the technology, wherein, in order to prevent the temperature increase in the non-sheet-transit region thus described, a cooling fan is provided in the image heating device so as to send air to the non-sheet-transit region of the heating material, so that the temperature increase is controlled. According to the technology recited in JP-A No. 04-51179, the cooling fan provided in the image heating device sends air selectively to a side where the non-sheet-transit region is provided.

In the technology recited in JP-A No. 04-51179, as shown in FIG. 9, air Z1 from a cooling air fan 1A collides with a fixing belt 20A and is thereafter split into air Z2 which is sent upward (downstream in a conveying direction) and air Z3 which is sent downward (upstream in the conveying direction). Accordingly, longitudinal ends of the fixing belt (heating film) 20A in an image heating device 101A are cooled down. However, the upward air Z2 is retained above the image heating device 101A, which excessively increases temperatures of a conveying guide 104A and a conveying roller 105A. As a result, problems are generated in the conveying process.

SUMMARY OF THE INVENTION

Therefore, the present invention provides an image heating device capable of preventing a recording material conveying path from being thermally affected by air flow from a fan to a heating rotating body and an image forming apparatus comprising: a heating rotating body which heats a toner image while nipping and conveying a recording material bearing the toner image; a fan which cools down the heating rotating body; and a duct adapted in such a manner that air which is blown by the fan so as to cool down the heating rotating body does not pass through a recording material conveying path.

Further features of the present invention will become apparent from the following description of exemplary embodiments (with reference to the attached drawings).

DESCRIPTION OF THE EMBODIMENTS

First Embodiment

Figure 1:
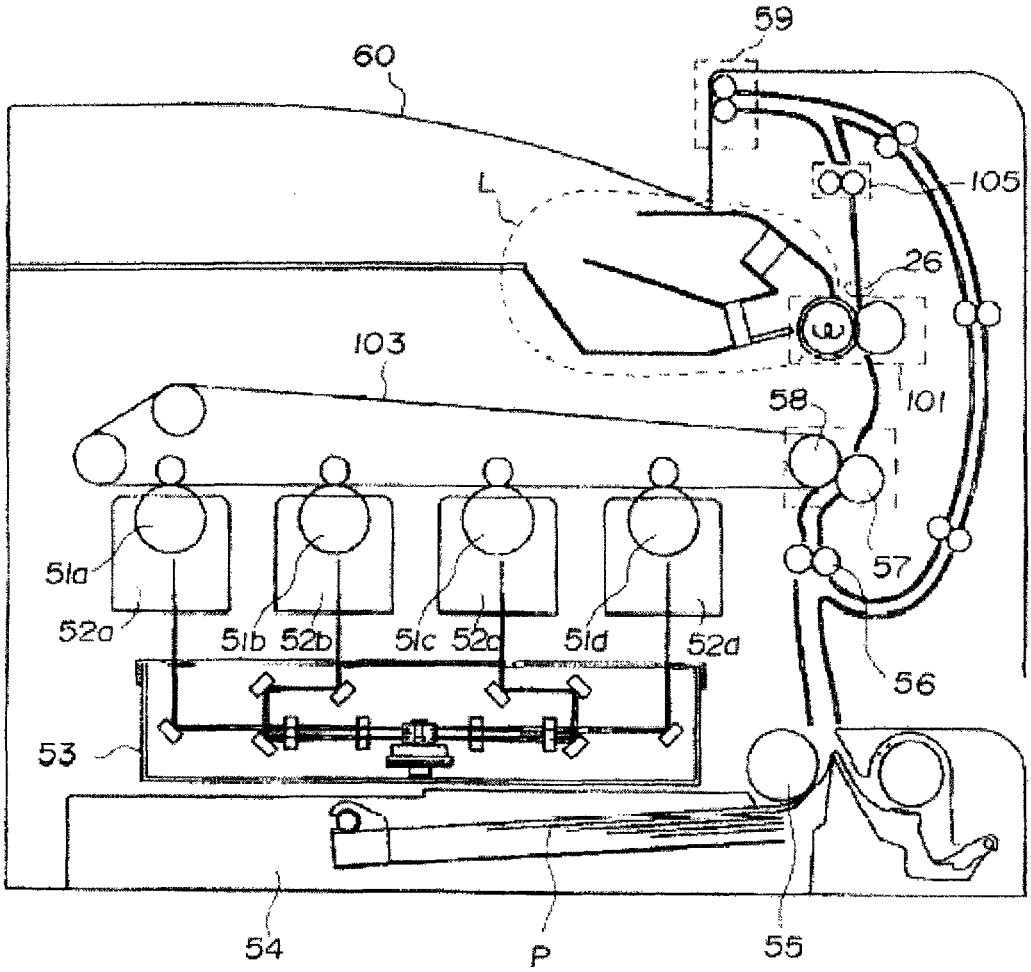
FIG. 1 illustrates a constitution of an image forming apparatus according to a first embodiment of the present invention.

A first embodiment of an image heating device according to the present invention is described referring to the drawings.

(Image Forming Apparatus)

FIG. 1 illustrates a constitution of an image forming apparatus. First, an image formation process by the image forming apparatus having an image heating device is described referring to FIG. 1. A printer, which is the image forming apparatus, forms toner images having the colors of yellow, magenta, cyan and black. As shown in FIG. 1, the image forming apparatus comprises photosensitive drums 51*a* (yellow), 51*b* (magenta), 51*c* (cyan) and 51*d* (black), which are four image bearing members provided in parallel, and an intermediate transfer belt 103. The intermediate transfer belt 103 is provided in upper sections of the photosensitive drums 51*a*-51*d* in such a manner that it extend across the respective photosensitive drums.

In a periphery of the photosensitive drums 51*a*-51*d*, a charger, a development device and a cleaner, which are not shown, are provided, which are unitized as process cartridges (image forming means) 52*a*-52*d*. The photosensitive drums 51*a*-51*d* are charged by the charger, and optical images color-separated and thereby having the respective colors, yellow, magenta, cyan and black, are exposed by an exposure device 53. Then, latent images of yellow, magenta, cyan and black are formed on the photosensitive drums 51*a*-51*d*. The respective latent images are developed by the development device so that toner images of yellow, magenta, cyan and black are formed on the photosensitive drums 51*a*-51*d*, which are then sequentially subjected to the primarily transferred onto the intermediate transfer belt 103.

A recording material P is housed in a sheet cassette 54. The sheet cassette 54 is adapted in such a manner that can be pulled out in a front-side direction in FIG. 1. In the case of the feed of the recording material P, jam recovery when the recording material P is jammed inside the sheet cassette 54, or the like, the sheet cassette 54 is pulled out toward the front side of the apparatus.

Each sheet of the recording material P is fed at a time from the sheet cassette 54 by a pickup roller (sheet conveying means) 55. After a timing adjustment is done by a registration roller 56, the recording material P is conveyed to a nip portion comprising a secondary transfer outer roller 57 and a secondary transfer inner roller 58 in the intermediate transfer belt 103, and the toner images on the intermediate transfer belt 103 are secondarily transferred thereonto. The recording material P onto which the toner images were secondarily transferred is conveyed to an image heating device (fixing device) 101 and subjected to heat and pressure, and the toner images are thereby fixed onto the recording material P. The recording material P on which a full-color print image is fixed is conveyed to a conveying path by a conveying roller 105 provided in the downstream of the image heating device 101 and is discharged into a discharge tray 60 by a discharge conveying means 59.

In a left direction L of the image heating device, a cooling means for cooling down heat of the fixing belt and an exhaust means for exhausting air are provided.

(Image Heating Device 101)

Figure 2A:
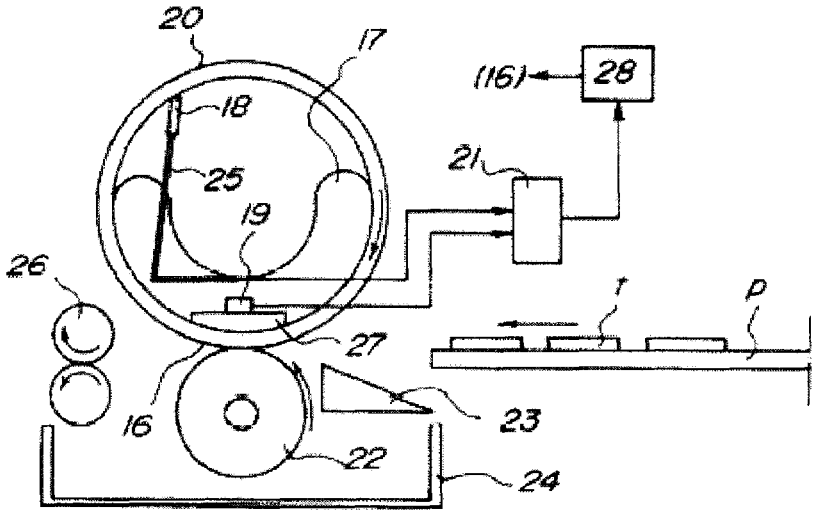
FIG. 2A illustrates a constitution of an image heating device and FIG. 2B is a perspective view of the image heating device.
Figure 2B:
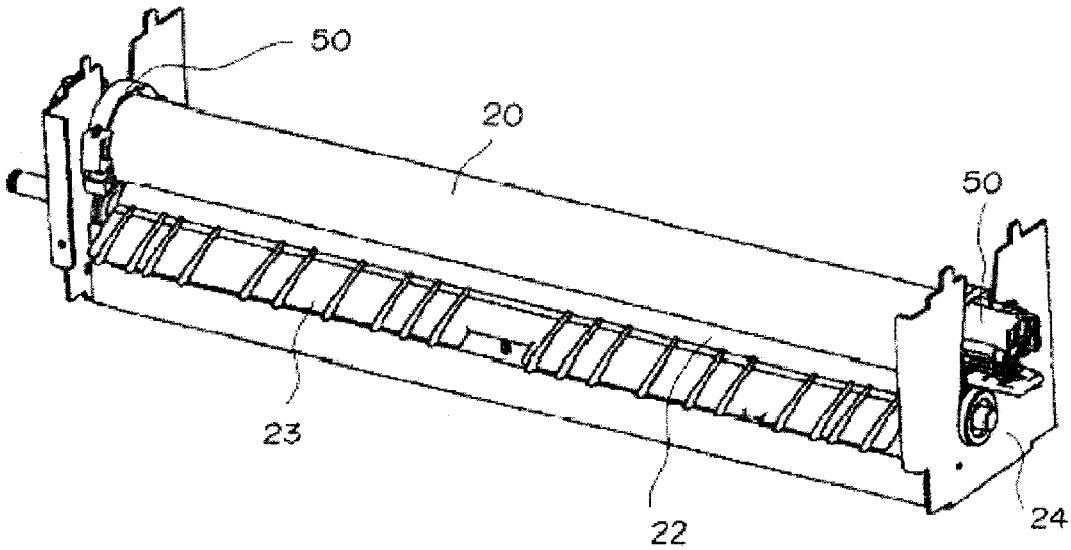

FIG. 2A illustrates a constitution of the image heating device 101. FIG. 2B is a perspective view of the image heating device 101. As shown in FIG. 2A, the image heating device 101 is a fixing device wherein a fixing belt heating method and a pressurizing rotating body driving method (tensionless type) are adopted. The image heating device 101 comprises a fixing heater 16, a heater holder 17, a fixing belt 20 and a pressure roller 22.

The heater holder (heating body retaining member) 17 has a cross-sectional surface having a substantially semicircular-arc barrel shape and has heat resistance and rigidity. The fixing heater 16 is a heating body (heat source), and is provided longitudinally along the heater holder 17 on a lower surface thereof.

The fixing belt 20 as a heating rotating body (first rotating body, first fixing member) is a member having a cylindrical shape (endless belt shape, sleeve shape) where an elastic layer is provided on a belt-shape member. The fixing belt 20 is externally loosely mounted on the heater holder 17, and ends thereof are energized by fixing flanges 50 as shown in FIG. 2B.

Describing the pressure roller 22 (second rotating body, second fixing member), a silicon rubber layer having the thickness of approximately 3 mm is formed on a stainless cored bar by means of the injection molding, and a PFA resin tube having the thickness of approximately 40 μm is provided thereon. The both ends of the cored bar of the pressure roller 22 are retained by means of bearings so as to freely rotate between side plates on rear and front sides of a device frame 24.

A fixing belt portion comprising the fixing heater 16, heater holder 17, fixing belt 20 and the like is provided on an upper side of the pressure roller 22 with the heater-16 side looking downward in parallel with the pressure roller 22. Then, the both ends of the heater holder 17 are energized in an axial-line direction of the pressure roller 22 by a pressurizing mechanism (not shown) with the force of 98N (10 kgf) on each side, the total pressure being 196N (20 kgf). Accordingly, the surface of the fixing heater 16 looking downward pressure-contacts the elastic layer of the pressure roller 22 via the fixing belt 20 by a predetermined pressing force against the elasticity of the elastic layer. As a result, a fixing nip portion 27 having a predetermined with necessary for the thermal fixing is formed. The pressurizing mechanism comprises a pressure releasing mechanism. When the pressure is released at the time of the jam recovery, or the like, the recording material P can be easily removed.

An inlet guide 23 and a fixing discharge roller 26 are incorporated in the device frame 24. The inlet guide 23 serves to guide the recording material P so that the recording material P which has passed through the second transfer nip is accurately guided to a fixing nip portion 27 which is a part of the fixing heater 16 where the fixing belt 20 and the pressure roller 22 pressure-contact each other. The inlet guide 23 is formed from polyphenylene-sulfide (PPS) resin.

The pressure roller 22 is rotated by a driving means (not shown) at a predetermined circumferential speed in a direction indicated by an arrow. A pressure-contact frictional force in the fixing nip portion 27 where the outer surface of the pressure roller 22 and the fixing belt 20 contact each other, which is generated by the rotation of the pressure roller 22 makes a rotational force act on the cylindrical fixing belt 20. Then, the inner-surface side of the fixing belt 20 is brought into close contact with the surface of the fixing heater 16 looking downward and thereby driven to slidably rotate in a direction indicated by an arrow in an outer periphery of the heater holder 17. The inner surface of the fixing belt 20 is coated with grease so that the slidability between the heater holder 17 and the fixing belt 20 is secured.

The pressure roller 22 is rotated, and the cylindrical fixing belt 20 is thereby driven to rotate. Then, the fixing heater 16 is power-supplied, and a temperature of the fixing heater 16 is thereby adjusted to reach a predetermined temperature. In this state, the recording material P on which the unfixed toner images are nipped is guided and introduced into between the fixing belt 20 and the pressure roller 22 of the fixing nip portion 27 along the inlet guide 23. Then, in the fixing nip portion 27, the surface of the recording material P which bears the toner images makes a close contact with the outer surface of the fixing belt 20. As a result, the recording material P is nipped and conveyed through the fixing nip portion 27 together with the fixing belt 20.

In the conveying process described above, heat of the fixing heater 16 is applied to the recording material P via the fixing belt 20, and unfixed images t on the recording material P are heated and pressurized onto the recording material P and thereby welded and fixed thereto. The recording material P which has passed through the fixing nip portion 27 is self-stripped from the fixing belt 20 and discharged by the fixing discharge roller 26.

(Cooling Device C)

Figure 3A:
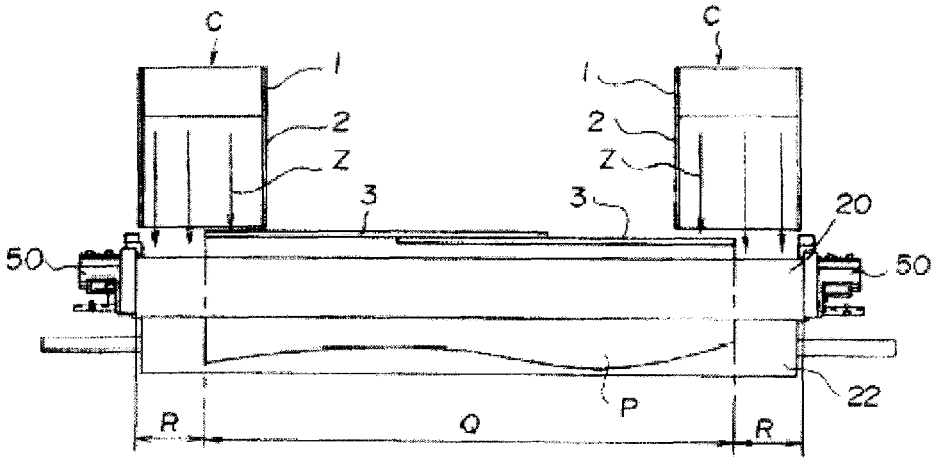
FIGS. 3A and 3C illustrate a constitution of a cooling device and FIG. 3B illustrates a shutter mechanism in an air-blow vent in a duct.

FIG. 3A illustrates a constitution of a cooling device C. As shown in FIG. 3A, the cooling device C comprises a cooling fan 1 and a non-sheet-transit region cooling duct 2. The cooling fans 1 are provided over the fixing belt, and the ducts 2 are respectively connected to the cooling fans 1. The cooling fans 1 and the ducts 2 are provided in vicinity of the longitudinal both ends of the fixing belt 20. As the cooling fan 1 is adopted an axial fan which is relatively low-cost in comparison to a multi-blade fan and a cross flow fan.

The respective ducts 2 send air of the cooling fans 1 into non-sheet-transit regions R so that the non-sheet-transit regions R are cooled down. The non-sheet-transit region R is a fixing region where small-size sheets (sheet having a width smaller than a largest-size sheet) do not transit when they continuously transit a fixing region Q.

In the constitution according to the present embodiment, the two cooling fans 1 are provided on the both ends. However, such a constitution that the duct 2 is branched so that the duct 2 in the vicinity of the fixing belt 20 sends the cooling air to the longitudinal both ends (non-sheet-transit regions) of the fixing belt 20 may be adopted. In the present embodiment, the non-sheet-transit region is provided on the longitudinal both ends of the fixing belt 20, however, may be provided on one of the ends of the fixing belt 20 in the case where the sheet is conveyed on the one-sided basis in place of the center basis.

(Shutter Mechanism)

Figure 3B:
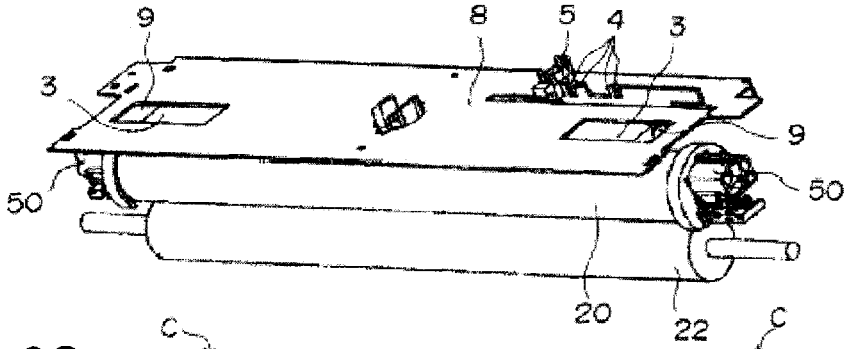

FIG. 3B illustrates a shutter mechanism (shutter frame 8, shutter 3) in an air-blow bent of the duct 2.

In an opening of the duct 2 on the fixing-belt side is provided a shutter frame 8. The shutter frame 8 has a duct opening 9 through which air from the duct 2 flows. The shutter frame 8 retains a shutter 3 capable of opening and closing the duct opening 9 to thereby open and close the shutter 3 by a pulse motor and a driving gear. The shutter 3 is opened at positions corresponding to respective sheet sizes when edge positions 4 determined depending on the sheet sizes are detected by a sensor 5, and the shutter 3. As a result, the opening can have a width suitable for the size of the fed sheet, and air can be thereby sent in an optimum width. The opening width is widened in accordance with the non-sheet-transit regions R which are increased in the case of the small-size sheet, while the opening width is reduced in accordance with the non-sheet-transit regions R which are reduced in the case of the large-size sheet.

(Thermistor)

Figure 3C:
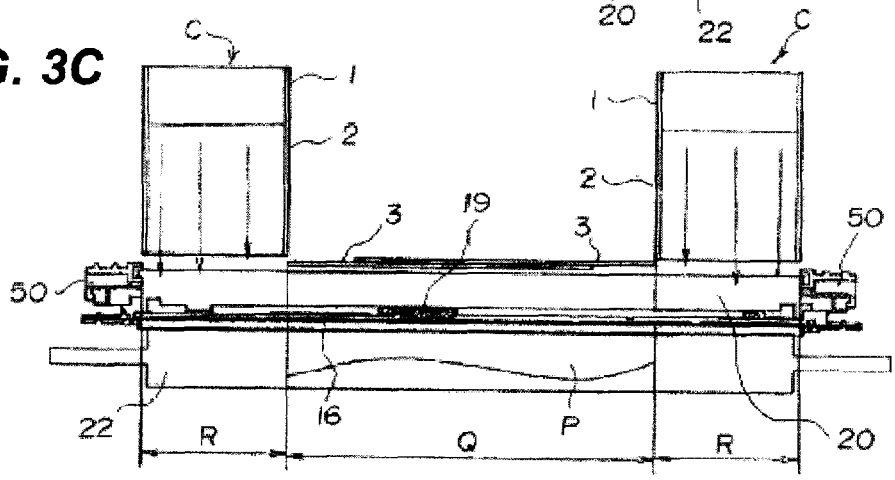

As shown in FIG. 3C, the image heating device 101 comprises a main thermistor 19 and a sub thermistor 18 which are first and second temperature detecting means.

As shown in FIG. 2A, the main thermistor 19 contacts the rear surface of the fixing heater 16 to thereby detect a temperature on the rear surface of the fixing heater 16. The sub thermistor 18 elastically contacts the inner surface of the fixing belt 20 above the heater holder 17 to thereby detect a temperature on the inner surface of the fixing belt 20.

The main thermistor 19 and the sub thermistor 18 are connected to a control circuit unit (CPU) 21 via an A/D converter, and detection results thereby obtained are outputted to the control circuit unit 21. The control circuit unit 21 decides details of the temperature control of the fixing heater 16 based on the outputs of the main thermistor 19 and the sub thermistor 18. Then, the control circuit unit 21 controls the power distribution for the fixing heater 16 using a heater driving circuit unit 28 which is a power supplier (heating means) to thereby control the temperature adjustment in the fixing heater 16.

(Operation of Cooling Fan 1)

Next, an operation of the cooling fan 1 is described.

In the case where the images are continuously fixed onto the small-sized sheets whose width is smaller than that of the largest-size sheet in the image formation, the temperatures in the non-sheet-transit regions R are increased. When the sub thermistor 18 which detects the temperature in the inner surface of the fixing belt 20 detects a temperature (operation starting temperature), the cooling fan 1 starts its operation and prevents the temperatures in the non-sheet-transit regions from further increasing. The cooling fan 1 halts its operation when the air supplied from the cooling fan 1 cools down the non-sheet-transit regions R and the temperature detected by the sub thermistor 18 is lowered to a certain temperature (operation halting temperature).

A temperature range in which the cooling fan 1 is turned on and off based on the temperature detected by the sub thermistor 18 of the cooling fan 1 is controlled to be variable depending on the operation statuses of the cooling fan 1.

The ON and OFF temperature range of the cooling fan 1 in the case where 100 B4-size sheets are continuously fed, for example, is controlled as follows. The operation starting temperature is set to 200° C. and the operation halting temperature is set to 190° C. in the case where the number of the fed sheets is 0-30. The operation starting temperature is set to 205° C. and the operation halting temperature is set to 195° C. in the case where the number of the fed sheets is 30-60. The operation starting temperature and the operation halting temperature are thereafter increased by 5° C. at every 30 sheets.

(Cooling Exhaust Device D in Non-Sheet-Transit Region R)

Figure 4:
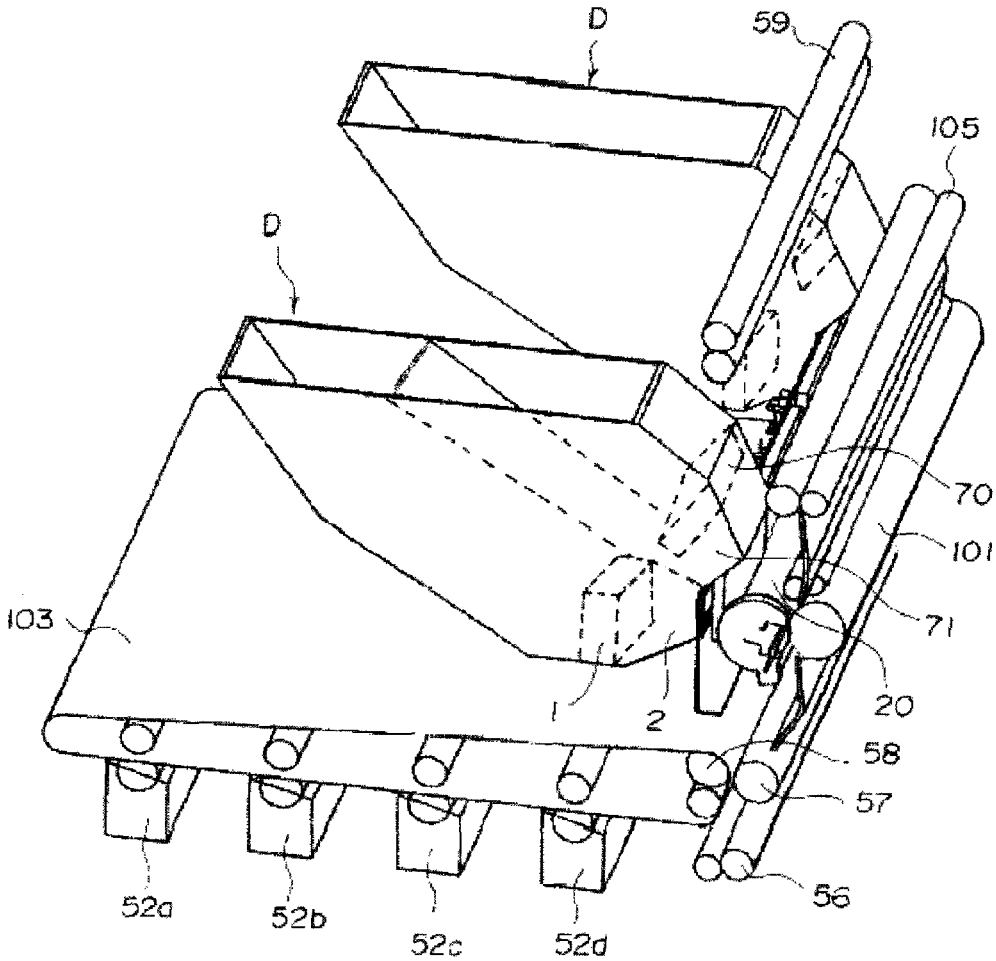
FIG. 4 is a perspective device of the image heating device.

FIG. 4 is a perspective view of the image heating device 101. As shown in FIG. 4, a cooling exhaust device D (cooling fan 1, duct 2, exhaust fan 70, exhaust duct 71) for cooling down the non-sheet-transit region R is provided on longitudinal both ends on the left side of the fixing belt 20 in the image heating device 101 (side opposite to the pressure roller 22). The cooling device C and the exhaust device (exhaust fan 70, exhaust duct 71), which are integrally formed, constitute the cooling exhaust device D. The cooling exhaust device D exhausts the air which cooled down the non-sheet-transit regions R from the cooling device C using the exhaust fan 70 and the exhaust duct 71.

Figure 5A:
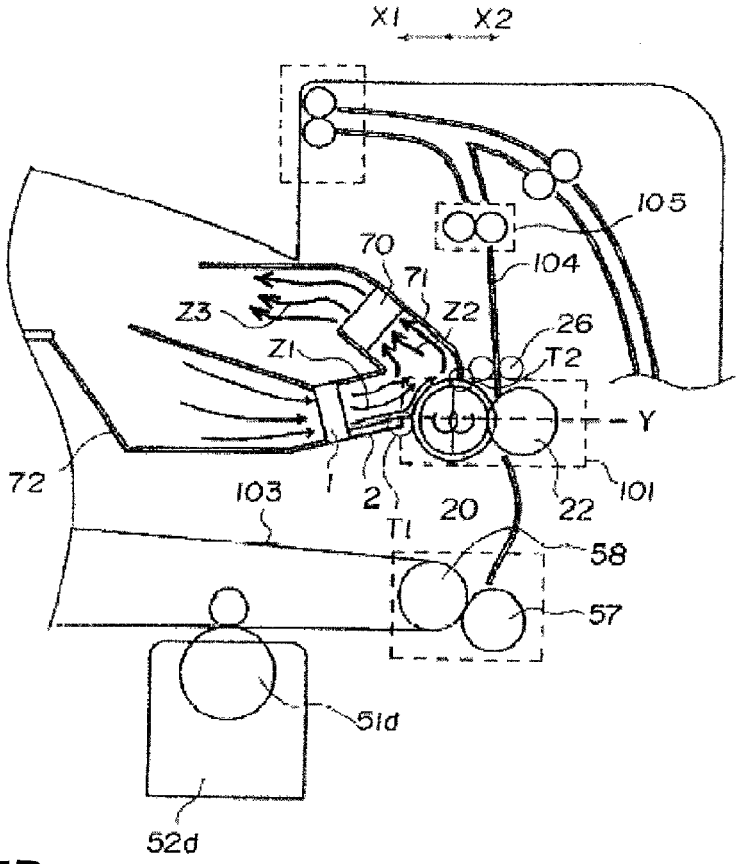
FIG. 5A is a sectional view of vicinity of the image heating device and FIG. 5B is a perspective view of the image heating device.
Figure 5B:
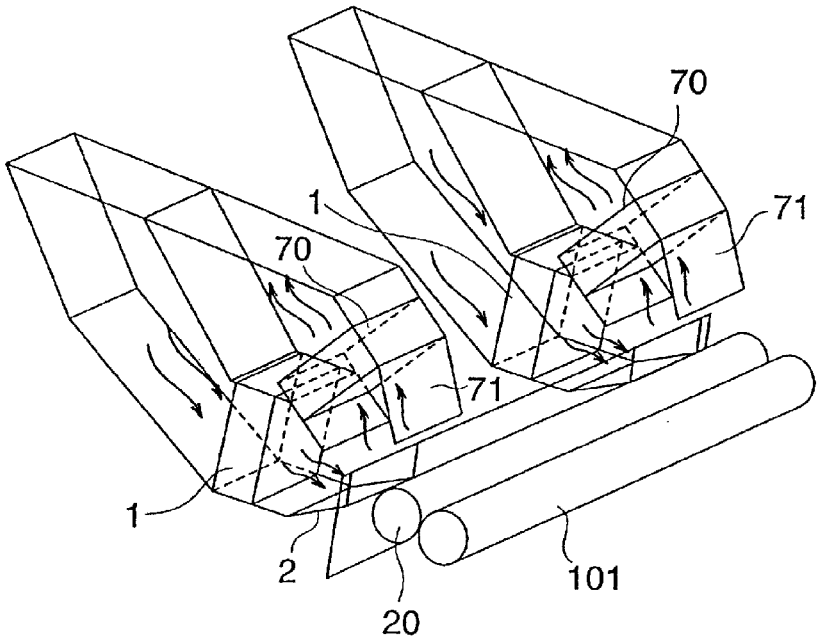

FIG. 5A is a sectional view of vicinity of the image heating device 101. FIG. 5B is a perspective view of the image heating device 101.

As shown in FIG. 5A, the duct 2 is formed in such a manner that the air Z1 from the cooling fan 1 blows toward a downstream side in a conveying direction relative to a central line Y of the fixing belt 20. The duct 2 is formed from an upstream side toward a downstream side in a direction where the fixing belt 20 is rotated. Accordingly, the air which cooled down the rotating body is subjected to a rotational force of the rotating body and thereby sent to the downstream side in the direction where the recording material is conveyed so as to make it difficult for the air to flow into an image forming portion. As a result, a temperature increase in the image forming portion can be prevented.

An edge of the duct 2 is formed extendingly to vicinity T1 of the fixing belt 20 (side opposite to the nip portion where it closely contacts the pressure roller 22). Accordingly, the air flow toward the image forming portion (secondary transfer portion 102, intermediate transfer belt 103, photosensitive drum 51*d*) can be controlled, and the cooling air from the duct 2 can be efficiently blown to the fixing belt 20.

The air Z2 which is blown to the fixing belt 20 and thereby goes upward (downstream side in the conveying direction) is suctioned and exhausted in the exhaust fan 70 via the exhaust duct 71, and then, exhausted as the air Z3. The exhaust duct 71 is provided in a vertically upper part of the main body of the image forming apparatus in comparison to the cooling device C (cooling duct 2). An edge of the exhaust duct 71 is formed extendingly to vicinity T2 of the fixing belt 20 (position on the downstream side in the conveying direction nearest to the fixing belt 20), and there is no air flow into a conveying portion (post-fixing conveying roller 26, conveying guide 104, conveying roller 105). Further, the duct 71 is formed from the vicinity T2 toward a discharge-tray-60 side. The exhaust duct 71 guides the air Z3 in a direction where the conveying path (conveying portion) of the recording material P and the image forming portion can be avoided. Accordingly, the exhaust device can exhaust the air which cooled down the fixing belt 20 in the direction where the conveying path of the recording material P and the image forming portion can be avoided. As a result, the temperature increases in the image forming portion and the conveying portion can be controlled.

As described, the exhaust fan 70 is provided above the cooling fan 1 so that the air from the cooling fan 1 is blown to the side opposite to the image forming portion of the fixing belt 20. As a result, the exhaust fan 70 can exhaust the air while preventing any air leak to the image forming portion.

The cooling fan 1, duct 2, exhaust fan 70, and exhaust duct 71 are set so that the air Z2 to the exhaust fan 70 is stronger than the air Z1 from the cooling fan 1. As a result, the air leak can be controlled, and the air can be reliably exhausted. A barrier wall 72 having a duct shape is provided on the air-intake side of the cooling fan 1 and above the intermediate transfer belt 103 so as to prevent the exhausted air Z3 from flowing toward the image forming portion (intermediate transfer belt 103 and the like).

When the air blown to the fixing belt (heating side) is thus introduced into the fan 1 again and circulated such that the recording material conveying path is skipped, any thermal deformation possibly generated by the hot air in the conveying guide and the conveying roller in the recording material conveying path can be prevented. Further, the image forming portion can be prevented from being thermally affected by the hot air remaining in the recording material conveying path.

Further, the exhaust air Z3 does not pass through the conveying portion. Therefore, the air path is not blocked when the sheet is fed though a large number of sheets are to be printed, and the air can be surely exhausted in any print job (even a large volume of printing job). As a result, the temperature can be prevented from excessively increasing.

In the present embodiment, the fixing belt 20 and the pressure roller 22 are used to heat and pressurize the image formed on the recording material P to thereby fix it thereon. However, these components may heat the images already fixed on the recording material P when it is nipped and conveyed.

Second Embodiment

Next, a second embodiment of the image heating device according to the present invention is described referring to the drawings. The same components as those described in the first embodiment are simply provided with the same reference symbols and not described again.

Figure 6:
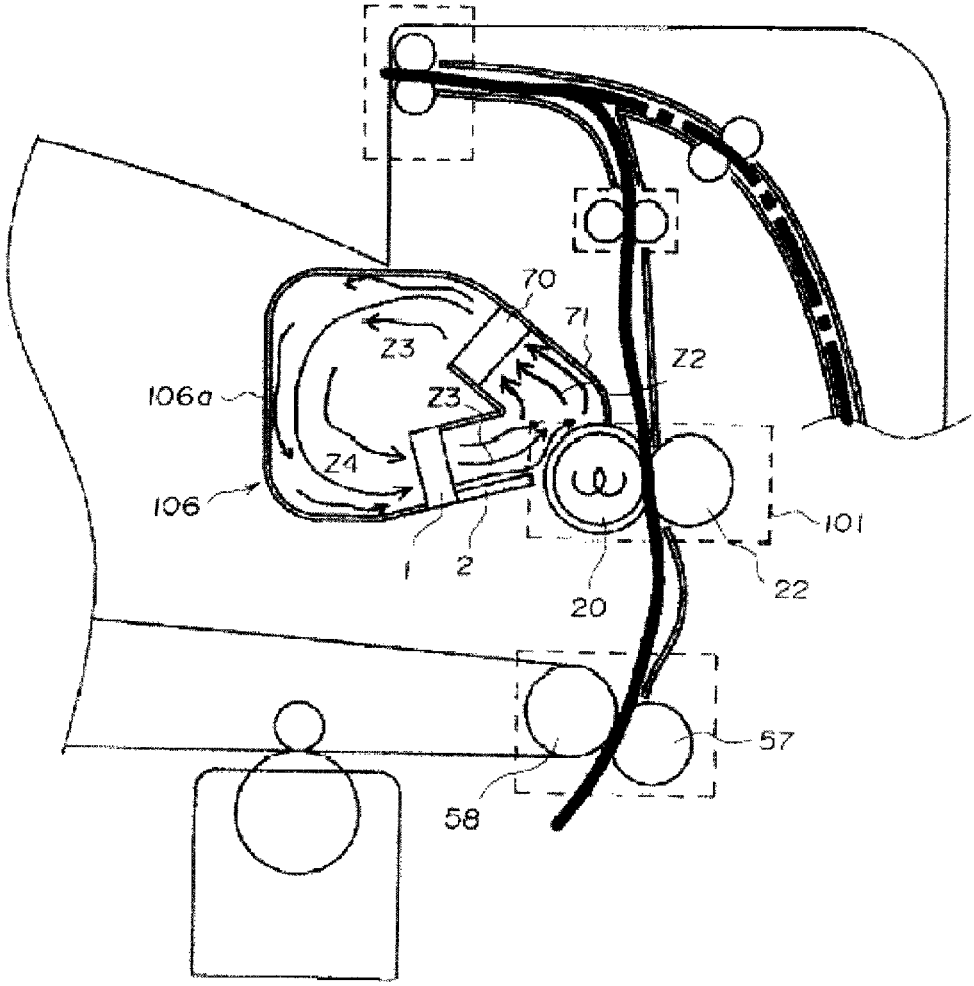
FIG. 6 is a sectional view of vicinity of an image heating device according to a second embodiment of the present invention.

FIG. 6 is a sectional view of vicinity of an image heating device 101. As shown in FIG. 6, the image heating device 101 according to the present embodiment has a cooling exhaust device 106 coupled with the duct 2 and the exhaust duct 71 in place of the cooling exhaust device D according to the first embodiment so that airs Z1-Z3 are circulated. More specifically, the cooling exhaust device 106 comprises a guide 106*a* which guides air Z4 from the exhaust fan 70 to the cooling fan 1 so that the exhausted air Z3 is suctioned into the cooling fan 1 as the air Z4.

The air Z1 sent from the cooling fan 1 is blown to the fixing belt 20, and thereafter suctioned by the exhaust fan 70 and exhausted as the air Z2 and then Z3. The exhausted air Z3 is suctioned again by the cooling fan 1 and turned into the air Z4, and then sent to the fixing belt 20 again as the air Z1. Such an air circulation as Z1→Z2→Z3→Z4→Z1 is accordingly realized.

Figure 7A:
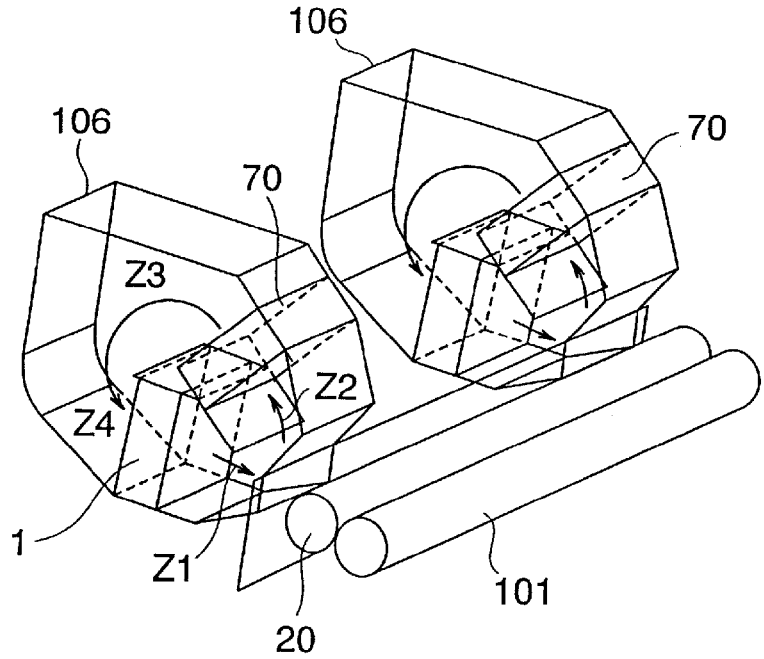
FIG. 7A and FIG. 7B are perspective views of a cooling exhaust device according to the second embodiment.
Figure 7B:
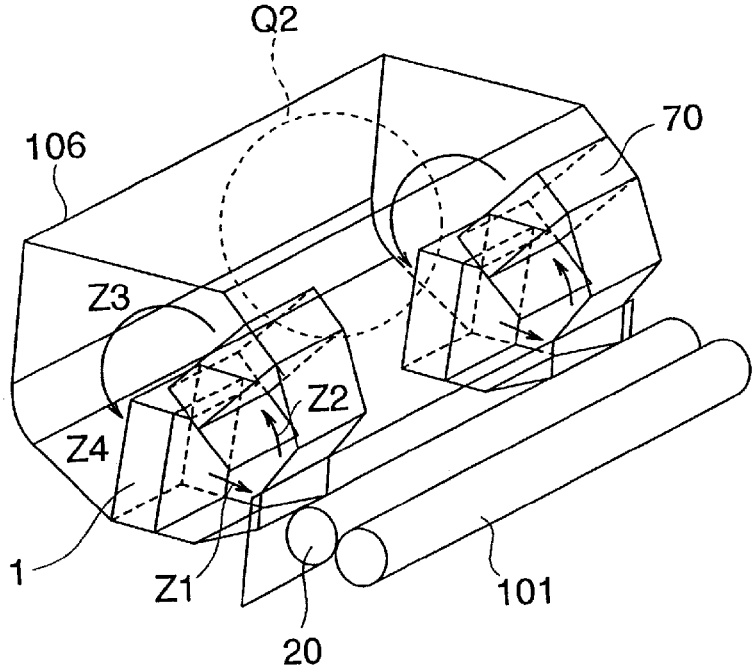

FIG. 7 is a perspective view of the cooling exhaust device 106. As shown in FIG. 7A, the cooling exhaust devices 106 may be provided in the longitudinal both ends of the fixing belt 20. As shown in FIG. 7B, the two cooling exhaust devices 106 shown in FIG. 7A may be coupled with each other to be formed into one device. In either of the constitutions, the cooling effect of the fixing belt 20 can be similarly obtained. The constitution shown in FIG. 7B is more advantageous in its air circulation balance because an amount of the air contained therein is increased because of a volume of a coupled portion Q2.

In the air circulation thus constituted, the air temperature inside the cooling exhaust device 106 is low enough though the heating temperature of the image heating device 101 is 200° C., which realizes the cooling effect at a satisfactory level.

In the constitution wherein the air is thus circulated, an effect similar to that of the first embodiment can be obtained.

In the present embodiment, the cooling fans 1 and the exhaust fans 70 are provided. However, the number of the fans is not particularly limited and may be one.

Third Embodiment

Next, a third embodiment of the image heating device according to the present invention is described referring to the drawings. The same components as those described in the first embodiment are simply provided with the same reference symbols and not described again.

Figure 8A:
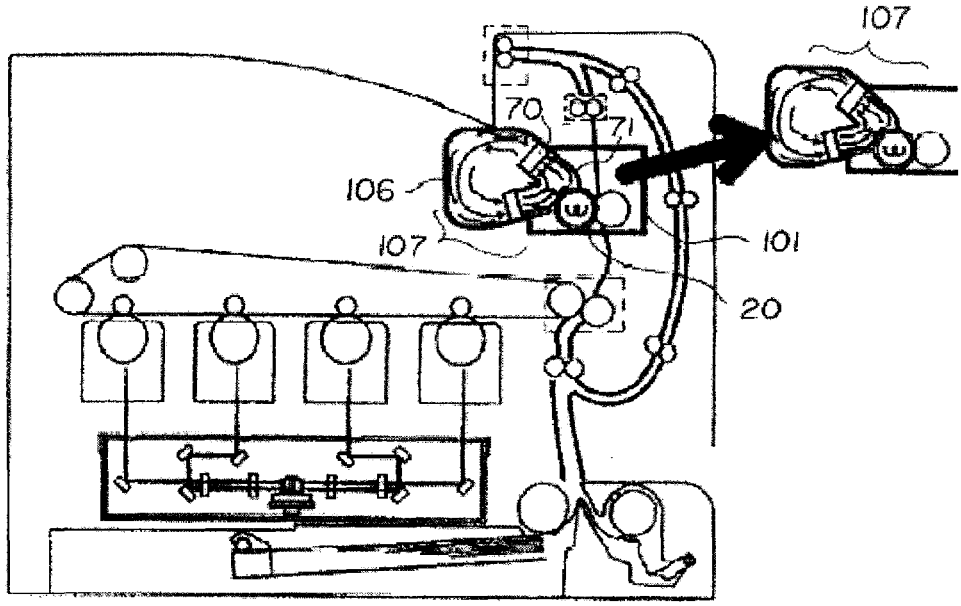
FIG. 8A is a sectional view of an image forming apparatus according to a third embodiment of the present invention and FIG. 8B is a perspective view of an image heating device according to the third embodiment.
Figure 8B:
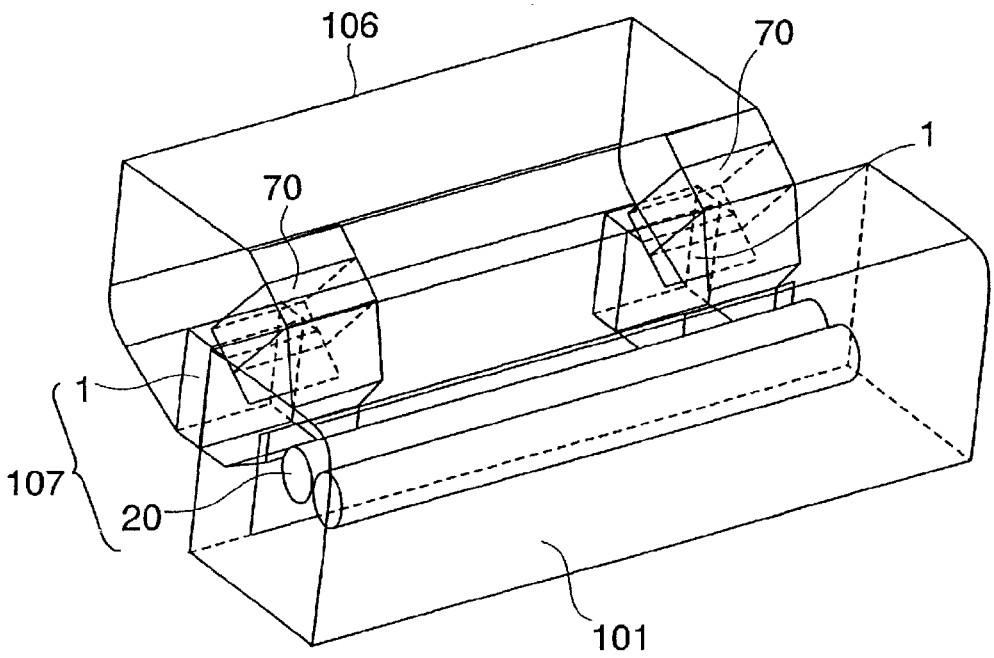
Figure 9:
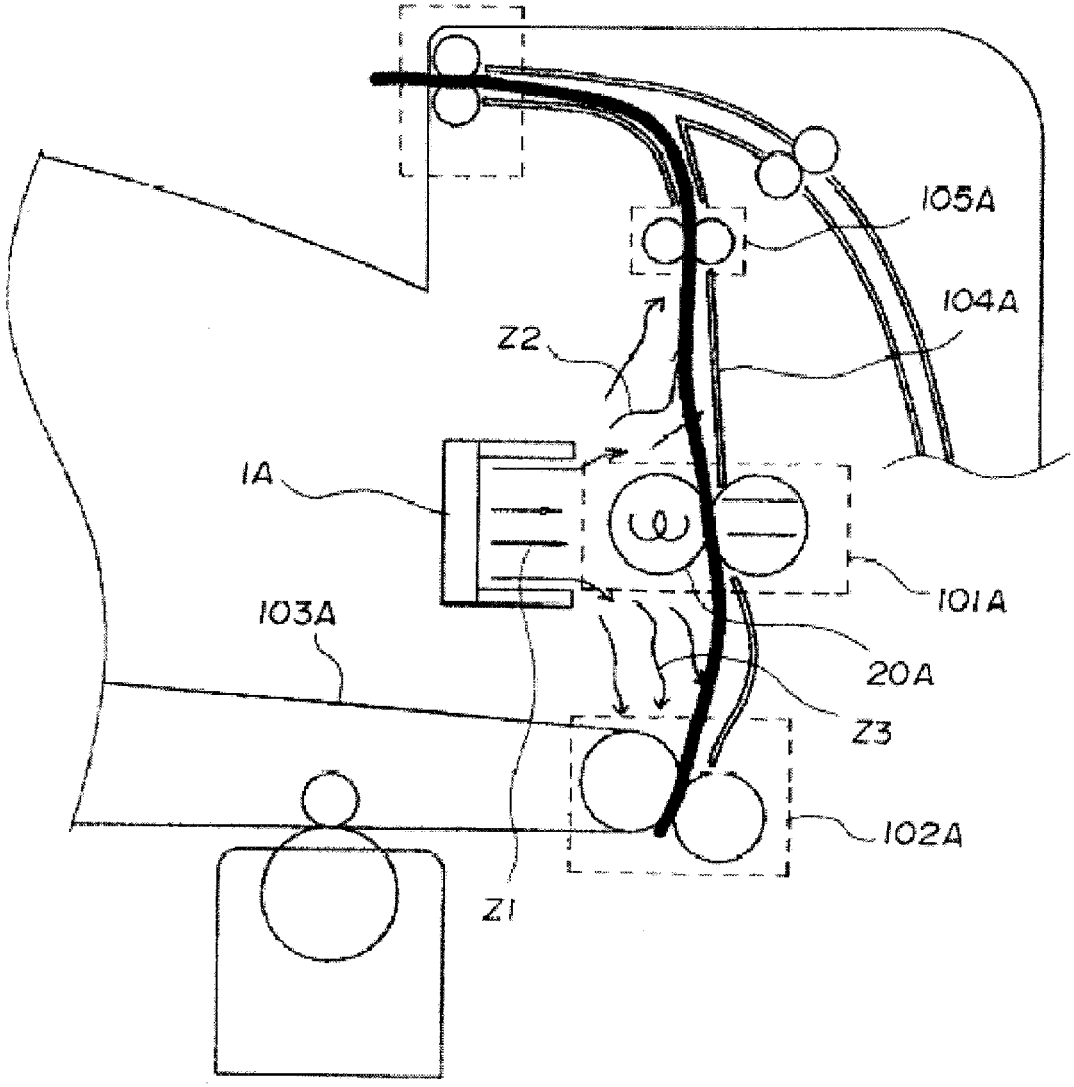
FIG. 9 PRIOR ART
FIG. 9 is an illustration of a conventional image heating device.

FIG. 8A is a sectional view of an image forming apparatus. FIG. 8B is a perspective view of an image heating device 107. As shown in FIG. 8, the cooling exhaust device 106 and the image heating device 101 according to the second embodiment, which are integrally formed, constitute the image heating device 107 according to the present embodiment.

According to the integral formation of the cooling exhaust device 106 and the image heating device 101, the cooling duct 2 for cooling the non-sheet-transit region and the exhaust duct 71 can be reliably positioned with a high accuracy relative to the fixing belt 20, which realizes a stable cooling performance. Further, the image heating device 107 can control heat-related operations such as heating and cooling, and possible thermal influences on other components can be thereby prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-184363, filed Jul. 13, 2007, which is hereby incorporated by reference herein in its entirety.

What is claimed is:

1. An image forming apparatus comprising:

a toner image forming device configured to form a toner image on a recording material;

an image heating member configured to heat the toner image on the recording material at a heating nip;

a conveying path for conveyance of the recording material heated by said image heating member toward a discharge tray;

a fan configured to blow air to cool said image heating member; and a circulating duct configured to guide the air from said fan toward said image heating member and guide the air blown to said image heating member toward said fan without passing through said conveying path.

2. The image forming apparatus according to claim 1, further comprising a shutter configured to change an opening width of said duct to change an area of said image heating member to be cooled.

* * * * *